United States Patent [19]

Mattossovich

[11] Patent Number: 4,712,399

[45] Date of Patent: Dec. 15, 1987

[54] CYLINDER LOCK WITH INTERCHANGEABLE KEY

[75] Inventor: Maria Mattossovich, Antrodoco, Italy

[73] Assignee: Rielda Serrature S.R.L., Roma Fiumicino, Italy

[21] Appl. No.: 933,540

[22] Filed: Nov. 21, 1986

[30] Foreign Application Priority Data

Dec. 19, 1985 [IT] Italy ..... 68073 A/85

[51] Int. Cl.[4] ..... E05B 27/04

[52] U.S. Cl. ..... 70/364 A; 70/383; 70/384; 70/419

[58] Field of Search ..... 70/383, 384, 382, 337, 70/338, 339, 340, 341, 342, 343

[56] References Cited

U.S. PATENT DOCUMENTS

| | | | |
|---|---|---|---|
| 1,610,224 | 12/1926 | Dalboni | 70/383 |
| 4,069,694 | 1/1978 | Raymond | 70/383 |
| 4,376,382 | 3/1983 | Raymond | 70/383 |

FOREIGN PATENT DOCUMENTS

| | | | |
|---|---|---|---|
| 2646739 | 4/1978 | Fed. Rep. of Germany | 70/384 |

*Primary Examiner*—Robert L. Wolfe

*Attorney, Agent, or Firm*—Young & Thompson

[57] ABSTRACT

A cylinder lock whose stator is a longitudinal groove and whose rotary cylinder has a key receiving slit, two series of seatings and two orthogonal slits; a series of sliders pushed by springs is inserted, with mobility in two directions, into the first series of seatings of the cylinder and cooperates with a key, and each slider is provided with projections and with a member for sliding engagement; a series of tumblers is slidingly inserted into the second series of seatings of the cylinder, and each tumbler is provided with recesses turned towards the sliders and with at least one recess at the opposite side; a stop bar pushed by springs is inserted into an orthogonal slit and is provided with projections turned towards the tumblers and with a continuous projection suitable for being inserted into the groove of the stator; and a translation bar pushed by springs is inserted into the other orthogonal slit of the cylinder, engages the members for sliding engagement of the sliders and is provided with a continuous projection suitable for being inserted into the groove of the stator; the parts are coordinated in such a manner that the stop bar immobilizes the tumblers until its continuous projection penetrates into the groove of the stator, and that the sliders engage the tumblers until the continuous projection of the translation bar penetrates into the groove of the stator, thus giving rise to a condition in which the key can be replaced by a different key.

8 Claims, 28 Drawing Figures

FIG. 1
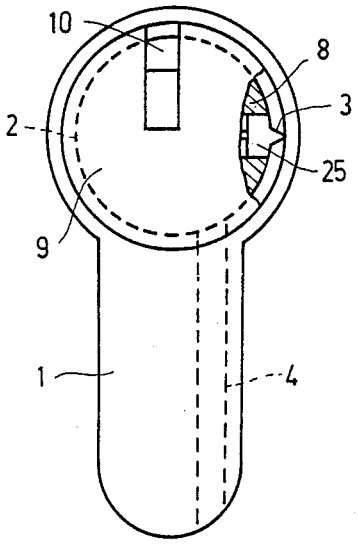
FIG. 2
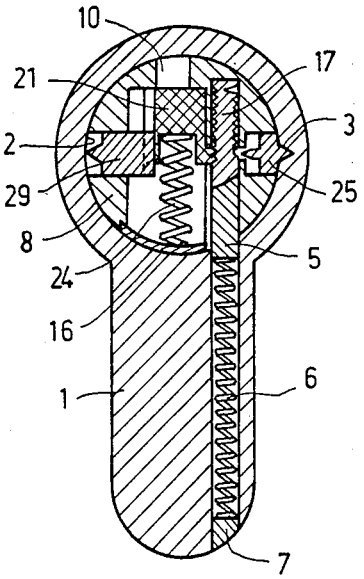
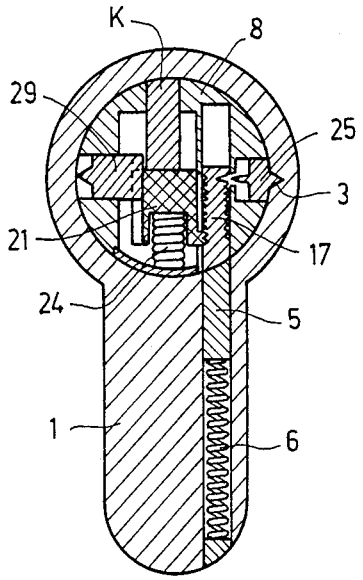
FIG. 3
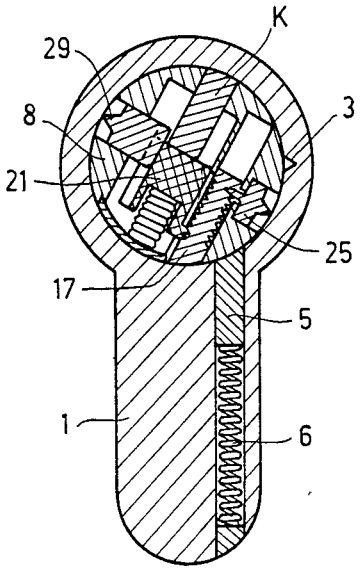
FIG. 4

FIG. 5
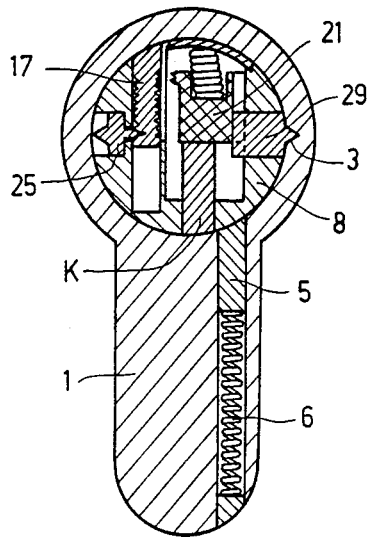
FIG. 6
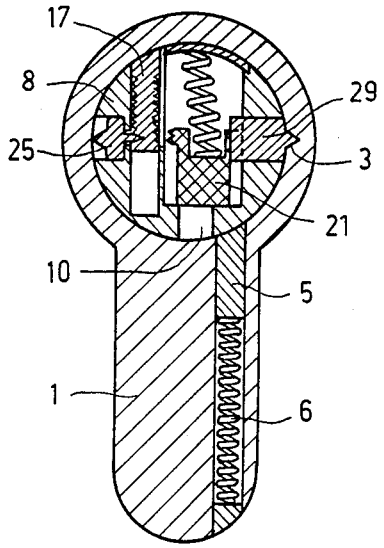
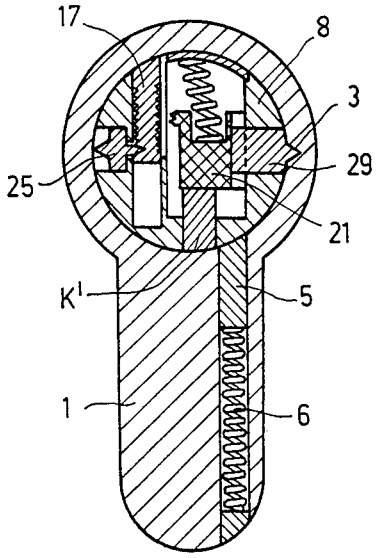
FIG. 7
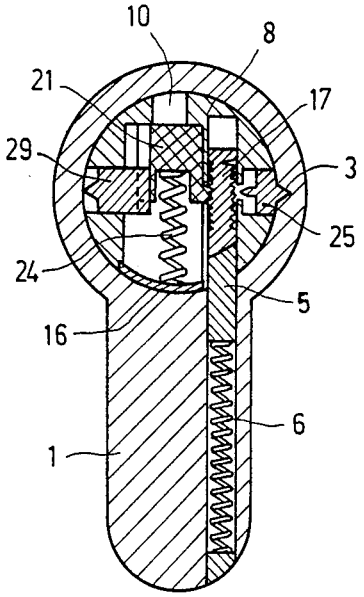
FIG. 8

FIG.13
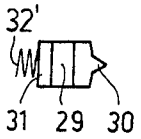
FIG.14
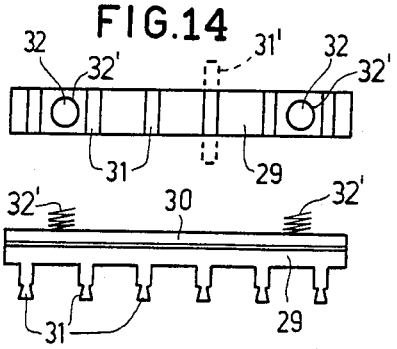
FIG.15
FIG.19 FIG.20
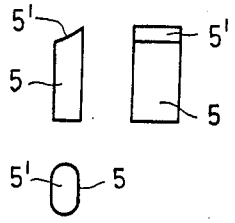
FIG. 21
FIG.16
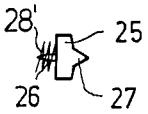
FIG.17
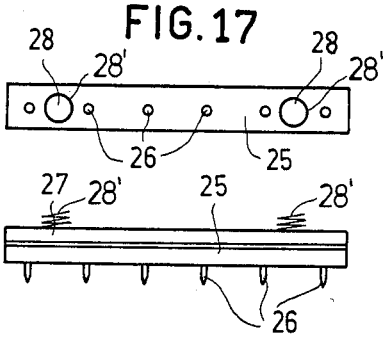
FIG.18
FIG.22 FIG.23
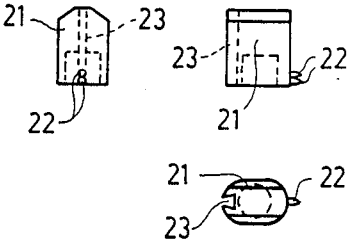
FIG. 24
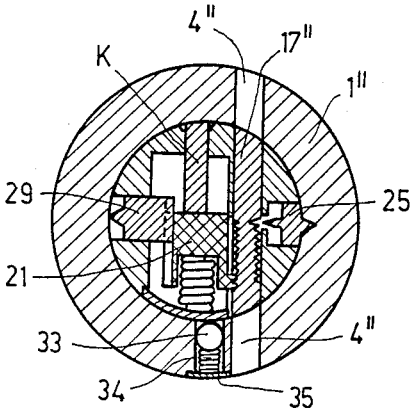
FIG. 28
FIG.25 FIG.26
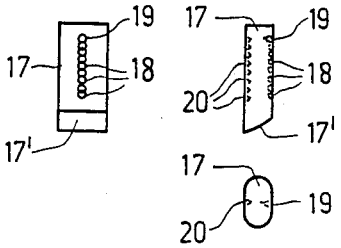
FIG. 27

CYLINDER LOCK WITH INTERCHANGEABLE KEY

BACKGROUND OF THE INVENTION

This invention relates to a cylinder lock with interchangeable key.

Cylinder locks with interchangeable key are already known, which for carrying out the change of the key require the use of a further auxiliary change key, or of a key partially different from that which previously served to actuate the lock, or even of another change device different from a key. In these locks, the operation of changing the key is connected with a certain difficulty, and this makes them less acceptable to the users; moreover, such locks are not capable of being coupled with many different kinds of keys, and therefore they can be used only with a limited number of possible different keys, and this reduces their safety. Their overall dimensions do not correspond to those of the usual locks, so that they can hardly substitute the already existing normal locks. Furthermore, their construction is delicate and can hardly be mechanized.

The object of this invention is to provide a cylinder lock of the type having an interchangeable key, i.e. a lock which allows, for safety reasons, to uncouple a key from the respective lock and to differently codify the lock in order to make it correspond to a different key, in which lock the operations required for changing the key are of maximum simplicity and, therefore, within anybody's capacity; and in which it is possible to use a great number of different keys, i.e. all those keys which can be manufactured for such lock depending on the configuration and the number of the movable elements provided in the lock.

It is also an object of the invention to allow subjecting a number of cylinder locks to a single key for opening, as well as to allow easy substitution of cylinder locks of usual industrial production by locks with interchangeable key.

SUMMARY OF THE INVENTION

These objects are attained, according to the invention, by means of a cylinder lock with interchangeable key, which comprises a stator with a cavity for a rotary cylinder, at least a longitudinal groove in said cavity, and a series of seatings which may extend at one or both sides of the cavity of the stator and may eventually contain counter-tumblers and respective springs; a rotary cylinder with a key receiving slit, a series of first seatings which intersect said key receiving slit and a series of second seatings, eventually passing through the cylinder, extending parallel to said first seatings, as well as a first and a second slit extending orthogonally to said seatings and parallel to the axis of the cylinder; a series of sliders inserted with longitudinal and transversal mobility into said first seatings of the cylinder in order to cooperate with the notches of a key inserted into said key receiving slit, each slider being provided on one side with projections and, on the opposite side, with a member for sliding engagement, and having an associated spring; a series of tumblers conforming at one or both their ends to the outline of the cylinder, slidingly inserted into said second seatings of the cylinder, corresponding to said seatings of the stator and provided with a series of first recesses turned towards said projections of the sliders and with at least one second recess turned towards the side opposite said sliders; a stop bar, inserted into said first orthogonal slit of the cylinder, provided with projections turned towards said second recess of the tumblers and with a continuous projection turned towards the opposite side and suitable for cooperating with said groove of the stator, and associated with springs which bias it towards the outside; and a translation bar, inserted into said second orthogonal slit of the cylinder, provided with members for sliding engagement suitable for engaging said members for sliding engagement of the sliders, and with a continuous projection turned towards the opposite side and suitable for cooperating with said groove of the stator, and associated with springs which bias it towards the outside; said components being coordinated in such a manner that said projections of the stop bar engage said second recesses of the tumblers when the continuous projection of the stop bar does not register with said groove of the stator, and disengage therefrom when said groove allows the stop bar to move towards the outside, whilst said sliders engage corresponding recesses of the tumblers when the continuous projection of the translation bar does not register with said groove of the stator, and disengage therefrom when said groove allows the translation bar to move towards the outside, thereby displacing the sliders by action of the respective sliding engagements.

Thanks to these characteristics, whenever the rotary cylinder has performed an odd number of half turns from the starting position, said translation bar reaches a position in register with said groove of the stator; it is then moved by its springs towards the outside and displaces the sliders which are coupled therewith through the sliding engagements. Owing to this transversal displacement, the sliders disengage from the tumblers and, in the thus reached position, they allow the removal of the key and its substitution by a different key. When the rotation of the cylinder is prosecuted, the translation bar is displaced again towards the inside, it makes the sliders engage again the tumblers, which in the meantime have been retained in their position by the stop bar, and thus give rise to a new codification of the lock in accordance with the new key.

The characteristics of the subject matter of the invention are compatible with the requirements of rational and mechanizable operations of assembly of the lock and of an economical storage thereof, and they ensure to the user a maximum easiness in the performance of the operations inherent in the new codification of the lock, i.e. in the change of its key. Thus, it is easy to subject to a single key the various locks pertaining to the same premises. In addition, the lock according to this invention can be given overall dimensions corresponding to those of a conventional lock, thus making easy the substitution of existing locks.

BRIEF DESCRIPTION OF THE DRAWINGS

These and other characteristics and advantages of the lock according to this invention will be more clearly apparent from the following description of an embodiment, given by way of a non limiting example, diagrammatically shown in the annexed drawings, wherein:

FIG. 1 is a front view of a first embodiment of a cylinder lock according to the invention, in which a portion of the cylinder head has been removed;

FIG. 2 is a transversal sectional views of the lock according to FIG. 1, shown in a rest condition, with the key removed therefrom;

FIGS. 3 to 7 show transversal sectional views of the lock, similar to that of FIG. 3, in various conditions which arise during the process of changing the key and giving the lock a new codification;

FIG. 8 is a transversal sectional view of the lock, similar to that of FIG. 3, with the lock now having a different codification;

FIGS. 13 to 15 are three orthogonal views of the translation bar;

FIGS. 16 to 18 are three orthogonal views of the stop bar;

FIGS. 19 to 21 are three orthogonal views of one of the counter-tumblers housed in the stator of the lock;

FIGS. 22 to 24 are three orthogonal views of the sliders intended to cooperate with the notches of the key;

FIGS. 25 to 27 are three orthogonal views of the tumblers, intended to cooperate with the counter-tumblers, with the sliders and with the stop bar; and FIG. 28 shows a transversal sectional view, similar to FIG. 3, of another embodiment of a cylinder lock according to this invention.

DETAILED DESCRIPTION OF THE INVENTION

Figure 9:
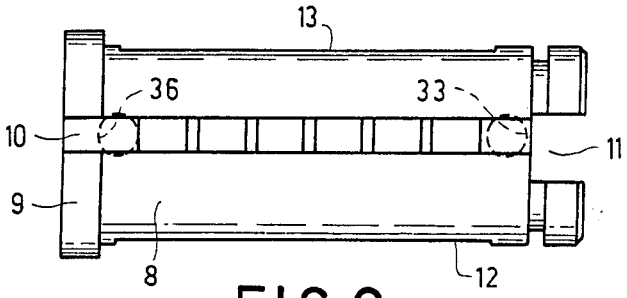
FIG. 9 is a side view showing only the rotor of the lock according to the foregoing figures, as seen from the top according to FIG. 2.
Figure 10:
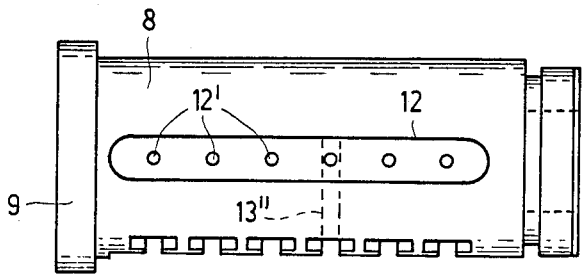
FIGS. 10 to 12 are other side views of the rotor according to FIG. 9, rotated each time through 90° in the left-hand direction according to FIG. 2.
Figure 11:
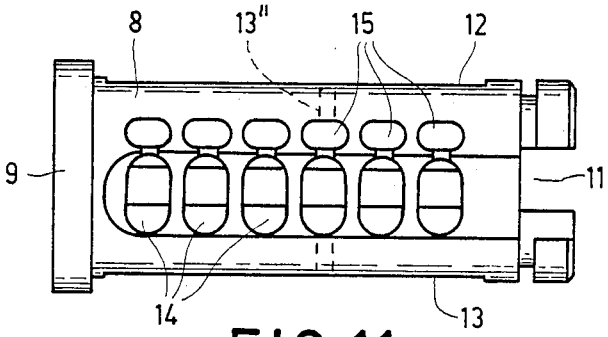
Figure 12:
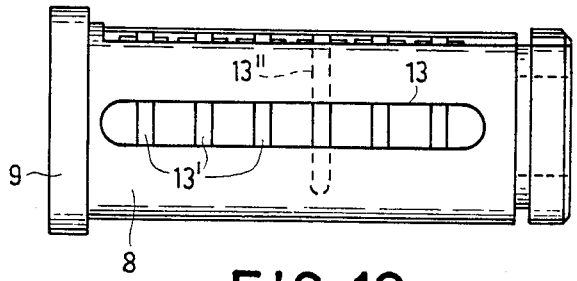

The cylinder lock with interchangeable key illustrated in FIGS. 1 to 27 is formed by a stator 1 having a cavity 2 in which there is rotatively mounted a rotor comprising a rotary cylinder 8 and a head 9. Formed in the wall of the cavity 2 of stator 1 there is at least one longitudinal stop groove 3. Perpendicularly to the cavity 2, there are formed in the stator a number of seatings 4 for counter-tumblers 5, which are pushed towards the cylinder 8 by springs 6 resting against plugs 7 which occlude the ends of the seatings 4. Each counter-tumbler 5 has a concave cylindrical surface portion 5' which, in a predetermined position of the counter-tumbler 5, registers with the skirt surface of cylinder 8 (and therefore it allows free rotation of the cylinder). The counter-tumblers 5 may be all identical to each other. The shape and the outer dimensions of the stator of the lock according to the invention may be equal to those of the usual cylinder locks, so as to allow an easy substitution of a common lock by a lock according to the invention.

A key receiving longitudinal slit 10 is formed in the rotary cylinder 8 and in the head 9 thereof. Slit 10 is represented, for the sake of simplicity, as having plane and parallel walls, but it is understood that it may have any one of the profiles which may be taken into consideration for the keys. Cylinder 8 is provided, at its rear end, with a transversal cavity 11 by means of which it may be connected to any known mechanism intended to be actuated by the lock, for example a mechanism for retraction of latches, which may be actuated by rotating the cylinder 8 by means of a suitable key inserted into the slit 10.

The cylinder 8 is provided with two diametrically opposite lateral slits 12 and 13, parallel to the axis of cylinder 8 and perpendicular to the key receiving slit 10, which are intended to receive a stop bar and a translation bar, respectively. In addition, in the cylinder 8 there are formed seatings 14 and 15 orthogonal to the axis of cylinder 8 and to the slits 12 and 13; seatings 14 intersect the key receiving slit 10 and are intended to receive sliders cooperating with the notches of the key, whilst seatings 15 are intended to receive tumblers cooperating with said sliders, with the counter-tumblers 5 housed in the stator of the lock, and with the stop bar. Said slits and the seatings formed in cylinder 8 are partially separated by walls. A cover 16 is intended to occlude the ends of the seatings 14 formed in cylinder 8.

Inserted into each seating 15 of cylinder 8 there is a tumbler 17 corresponding to one of the counter-tumbler 5 of stator 1. Each tumbler 17 has a convex cylindrical surface portion 17', complementary to the concave surface 5' of the counter-tumbler 5, and is provided, on its outer face, with a plurality of shallow recesses 18 and a deeper recess 19, and, on its inner face, with a similar plurality of recesses 20. The recesses 18–20 may, for example, be conical, dihedral, rack shaped or of a similar shape. The deeper recess 19 is situated in such a position as to be in register with the slit 12 of cylinder 8 when the surface 17' is in register with the skirt surface of cylinder 8, and is the only recess among the recesses 18–19 which has an operative function; the remaining recesses 18 have a simulation function intended to hinder actions tending to decode the codification of the lock. Although recesses 18 of reduced depth are sufficient for the simulation purposes, for the sake of manufacturing convenience the recesses 18 may also be made deeper, such as recess 19, and in this case recesses 18 and 19 are identical to each other. The tumblers 17 may be all identical to each other.

Inserted into each seating 14 of cylinder 8 there is a slider 21 having on one of its flanks one or more projections 22, for example conical or shaped like a chisel point or like a rake, adapted to engage the recesses 20 of the tumblers 17, whilst on the opposite flank of slider 21 there is formed a groove 23 for sliding engagement, for example in the form of a dovetail. Each slider 21 is slidingly housed in the corresponding seating 14 and it is pushed towards the outside by a spring 24 which rests on cover 16; in addition, each slider 21 is mounted with some clearance in the seating 14 so as to be able to move transversally between two positions, in one of which its projections 22 are engaged with the recesses 20 of the corresponding tumbler 17, whilst in the other position the projections 22 are disengaged. Sliders 21 may be all identical to each other.

Inserted into the slit 12 of cylinder 8 there is a stop bar 25 which is provided, for each tumbler 17, with ore or more projections 26, for example conical or shaped like a chisel point or like a rake, which are suitable for engaging the recesses 18 or 19 of the tumblers 17. This engagement is made possible by holes 12' formed in the wall which separates the slit 12 from the seatings 15. At the side opposite the projections 26, the stop bar 25 has a stop projection 27 suitable for penetrating into the stop groove 3 of stator 1. Finally, the stop bar 25 has some seatings 28 for springs 28' intended to elastically push it towards the outside of the slit 12 which houses the stop bar 25. However, the seatings 28 for springs 28' could also be provided in cylinder 8, rather than in stop bar 25.

Inserted into the slit 13 there is a translation bar 29 which has at the outer side a projection 30 similar to the stop projection 27 of the stop bar 25. The translation bar 29 has at the inner side projections 31 for sliding engagement, in a number equal to the number of sliders 21.

The projections 31 may, for example, be shaped like a dovetail (as shown), or with an end border circularly expanded, and are intended to engage within the grooves 23 for sliding engagement of the sliders 21, which are shaped in a complementary way. This engagement is made possible by slots 13', formed in the wall which separates the slit 13 from the seatings 14 of cylinder 8, through which slots the projections 31 for sliding engagement extend into the seatings 14. To the projections 31 could also be given a height greater than that of the translation bar 29, in order to attain a more effective guidance, as shown in phantom at 31' in FIG. 14. Moreover, the translation bar 29 is provided with some seatings 32 for springs 32' intended to elastically push it towards the outside of the slit 13 which houses the translation bar 29. However, the seatings 32 for springs 32' could also be provided in cylinder 8, rather than in translation bar 29.

The holes 12' and slots 13' give rise only to a very reduced weakening of cylinder 8, and therefore they are particularly suitable when the cylinder is made of a metal having a reduced strength. When, on the contrary, cylinder 8 is made of a metal having a high strength, such as, for example, stainless steel, the holes 12' and the slots 13' may be replaced by longer millings 13'', as shown in phantom, for one position only, in FIGS. 10 to 12. This allows simplifying the manufacture of cylinder 8.

The structure described hereinabove, although it may seem complicated, is suitable for being assembled in a very rational and mechanizable manner. Once the tumblers 17 have been inserted into the seatings 15 of cylinder 8, with the convex surfaces 17' corresponding to the skirt surface of the cylinder, the insertion of the stop bar 25 (whose projections engage the recesses 19 of the tumblers 17) immobilizes all the tumblers in their positions. The translation bar 29 is then inserted, but not deeply, into the slit 13, in such a manner that its members 31 for sliding engagement extend within the seatings 14, and into these latter are inserted the sliders 21, thereby engaging the members 31–23 for sliding engagement, then the springs 24 are inserted, and finally the seatings 14 are occluded by means of the cover 16. Then, by deeply inserting the translation bar 29, the projections 22 of the sliders 21 are brought into engagement with the recesses 20 of the tumblers 17; thus, all the movable parts remain immobilized as long as the bars 25 and 29 are kept deeply inserted into the respective slits, by suitable retainer means, against the action of their springs. In this condition, there is nothing projecting with respect to the skirt surface of cylinder 8, and therefore this latter can be inserted into the stator 1, the wall of whose cavity then replaces the retainer means which formerly retained in their position the bars 25 and 29. Cylinder 8 may then be axially fixed within the stator, without hindering the rotation thereof, in any one of the known ways, for example by means of an elastic ring. Finally, the lock is completed by inserting into the stator 1 the counter-tumblers 5, the springs 6 and the respective plugs 7. As it can be seen, these steps can be carried out even by mechanical means, especially because they do not include any selection of parts corresponding to a specific codification of the lock, since the counter-tumblers, as well as the tumblers and the sliders, are all identical to each other. In effect, the lock prepared in this way is not codified at all and it can be actuated by a neutral key or by any instrument inserted into the key receiving slit 10 without displacing the sliders 21. The lock will be codified successively, as it will be explained later on, but meanwhile it may be stored without any reference to corresponding keys, thus obtaining a further advantage in organisation and economy. Finally, the lock will be installed and, if desired, it can still be utilized with a neutral key; this procedure allows, among other things, to use a single neutral key for all locks of a building in the course of being finished. Only when the user takes possession of the premises the lock should be codified by a key chosen by the user himself, which key has been never before in possession of any other person and which, if desired, could be the same for all the locks pertaining to the same premises.

With particular reference to FIGS. 2 to 8 of the drawings, the operation of the lock described hereinabove will now be explained, particularly in respect of the steps which are required for its recodification on the occasion of the change of the associated key; the same steps, of course, also serve for the first codification of the lock.

FIG. 2 shows a section of the lock, codified in any manner whatever and in rest conditions, i.e. with the key extracted from the slit 10. In these conditions the counter-tumblers 5 of stator 1, pushed by the springs 6, partially penetrate into the seatings 15 of cylinder 8, thus immobilizing the cylinder. The stop bar 25 does not immobilize the tumblers 17 because, under the action of its springs, it penetrates with its projection 27 into the longitudinal groove 3 of the stator, thus disengaging the projections 26 from the holes 19 of the tumblers 17: these latter are lifted by the sliders 21, which engage them through the projections 22 and the recesses 20 and are pushed by the springs 24. Cylinder 8 cannot rotate: the lock is blocked.

Referring to FIG. 3, if a key K is inserted for the whole length thereof into the slit 10 of the lock, this action gives rise to a vertical displacement of the sliders 21 against the action of the springs 24, according to the height of the teeth of the key; then, the sliders 21 rest against the notches of the key thereby assuming a specific position and displacing the tumblers 17. If the positions thus attained by the movable parts correspond to the codification of the lock, i.e., if the inserted key K is exactly the one which is associated with the lock, the tumblers 17, by pushing the counter-tumblers 5, assume a position in which their convex surfaces 17' correspond to the skirt of cylinder 8 and their recesses 19 face the projections 26 of the stop bar 25. Cylinder 8, no more immobilized by the counter-tumblers 5, can then be rotated by means of the key K (FIG. 4). At the beginning of this rotation, the stop bar 25 is pushed towards the inside owing to the cooperation of its projection 27 with the longitudinal groove 3 of the stator, and its projections 26 engage the recesses 19 of tumblers 17, thereby locking these latter along with the sliders 21 in their positions, and thus hindering the extraction of the key. In this condition, cylinder 8 can be rotated through one or more complete turns in order to actuate the lock, in the usual manner, and thereafter the stop bar 25, which finds again the groove 3 in front if its projection 27, again moves towards the outside, thereby leaving free the tumblers 17 along with the sliders 21, whereby the key can be extracted.

However, each time the cylinder 8 has carried out an odd number of half turns from the start position (FIG. 5), the translation bar 29 finds the groove 3 of the stator facing its own projection 30 and, being pushed by its own springs, moves towards the outside. Through this movement it displaces transversally also the sliders 21, since the members 23 for sliding engagement of these latter are engaged with the members 31 for sliding engagement of the translation bar 30. As a consequence, the projections 22 of the sliders 21 disengage from the recesses 20 of the tumblers 17, which however are kept stationary by the action of the stop bar 25.

The position which has now been described constitutes a position in which the change of the key is allowed. In effect the sliders 21, being disengaged from the tumblers 17, have recovered their mobility, and they do no more retain the key K, which can be extracted (FIG. 6). All the sliders 21 are then pushed to the end of their stroke by the action of the springs 24, and if at this point the cylinder were still made to rotate without a key, the lock would return to a not codified condition, and could be actuated by means of a neutral key. If, on the contrary, a new key K′ is inserted into the slit 10 (FIG. 7), each slider 21 assumes a new position corresponding to the series of notches of the new key K′. Then, by making the cylinder 8 rotate by means of the new key K′, the translation bar 29 is pushed towards the inside as a result of the cooperation between its projection 30 and the groove 3 of the stator, and it pushes the sliders 21, thus making them engage by means of their projections 22 some recesses 20 of tumblers 17, but not the same recesses which were engaged by the projections 22 prior to the change of the key, and the lock will then continue its regular operation, by now codified for the new key K′. The lock will then remain codified in this way when the key K′ will be extracted (FIG. 8). The comparison of the FIGS. 8 and 2 evidences that, because of the different codification of the lock, the relative positions of the sliders 21 and the corresponding tumblers 17 have been modified.

Therefore, as it can be understood, in the lock described hereinabove the operation of changing the key attains the maximum conceivable simplicity, inasmuch as it simply consists in the extraction of the old key and in the insertion of a new key, these steps being carried out when the lock is in a particular position, i.e. with the key rotated through 180° with respect to the normal position of extraction. Such a simplicity may even be considered excessive, and in this case it is possible to take measures for preventing any undesired change of the key, but such measures may easily be adapted to any practical requirement, inasmuch as they are not imposed by characteristics of the lock itself. In particular, any means which temporarily hinders the displacement of the translation bar 29 towards the outside may be used for preventing the change of the key without such means having been previously neutralized.

It is also possible to provide, for the operation of the translation bar 29, one or more grooves in the stator, different from those with which the stop bar 25 cooperates, thus obtaining for the change of the key positions which differ from the position described hereinabove. The positions allowing changing the key may be one or more. In particular cases, the position allowing changing the key may also be made correspond to the position of lock opening.

Although the members for sliding engagement have been indicated as formed by projections 31 on the translation bar 29 and by grooves 23 in the sliders 21, it is to be understood that this arrangement may be inverted. Also, the sliding engagement members stated as having a dovetail configuration could be T-shaped or have any other suitable profile.

Hitherto, the invention has been described with reference to a lock in which the seatings of the stator extend at one side only and are provided with counter-tumblers and respective springs, but it is to be understood that the invention may equally apply to that kind of locks in which the seatings of the stator extend at both sides relative to the cylinder, and in this case they may eventually be free, at one or both sides, of any counter-tumblers and respective springs; the seatings for the tumblers are then passing through the cylinder, and the tumblers inserted therein should conform at both their ends, to the outline of the cylinder in the positions of opening and of change of the key.

Such an arrangement is shown in FIG. 28. In this case, the stator 1″ has a thickness corresponding to the stroke of the tumblers 17″, and it may be substantially cylindrical. The tumblers 17″ have at both ends surfaces which, in the opening position (shown in FIG. 28) conform to the outline of the rotary cylinder. The seatings 4″ of stator 1″ extend at both sides of cylinder 8, and they are free from counter-tumblers and springs. The further components included in cylinder 8 are identical to those already described, and also identical is their operation, and therefore they are not further described herein.

FIG. 28 further shows a ball 33 having a pressure spring 34 resting against a covering 35, these parts being inserted in stator 1″ in a position registering with the inner end of key K when the lock is in the position allowing changing the key (see also FIG. 9). Ball 33 engages cylinder 8 (thus preventing its rotation) if the key has not been completely inserted in the key receiving slit, and thus it prevents any possibility of wrong codification of the lock due to incomplete insertion of the key.

Another similar assembly of a ball with spring may be provided at 36 (FIG. 9), at the outer end of the key web. This ball prevents extraction of the key, when the cylinder is in the position allowing changing the key, if the key has a recess registering with ball 36. Therefore, it is possible to provide keys having such a recess, which do not allow changing the codification of the lock, whereas other keys, not having such a recess, allow changing the codification. These latter keys may therefore be delivered only to specific persons authorized to change the codification, whereas any other person provided with a key suitable for opening the lock cannot modify the codification thereof.

The invention may be applied both to locks for doors in buildings and the like and to locks for safety boxes, armored lockers or the like.

I claim:

1. A cylinder lock with interchangeable key, comprising: a stator, in said stator a cavity, at least a longitudinal groove, and a series of seatings extending at least at one side of said cavity; a rotary cylinder mounted in said cavity of the stator, in said cylinder a slit suitable for receiving a key, a series of first seatings which intersect said key receiving slit, a series of second seatings extending parallel to said first seatings, and a first and a second slit extending orthogonally to said seatings of the cylinder and parallel to the axis of the cylinder; a series of sliders inserted with longitudinal and transversal mobility into said first seatings of the cylinder in order to cooperate with the notches of a key inserted into said key receiving slit, each slider having on one side a number of projections and, on the opposite side, a member for sliding engagement, and having an associated spring; a series of tumblers conforming at least at one of their ends to the outline of the cylinder, slidingly inserted into said second seatings of the cylinder, corresponding to said seatings of the stator and having a series of first recesses turned towards said projections of the sliders and at least one second recess turned towards the side opposite said sliders; a stop bar, inserted into said first orthogonal slit of the cylinder, having a number of projections turned towards said second recess of the tumblers and a continuous projection turned towards the opposite side and suitable for cooperating with said groove of the stator; and a translation bar, inserted into said second orthogonal slit of the cylinder, having a number of members for sliding engagement suitable for engaging said members for sliding engagement of the sliders, and a continuous projection turned towards the opposite side and suitable for cooperating with said groove of the stator; said components being coordinated in such a manner that said projections of the stop bar engage said second recesses of the tumblers when the continuous projection of the stop bar does not register with said groove of the stator, and disengage therefrom when said groove allows the stop bar to move towards the outside, whilst said sliders engage corresponding recesses of the tumblers when the continuous projection of the translation bar does not register with said groove of the stator, and disengage therefrom when said groove allows the translation bar to move towards the outside, thereby displacing all the sliders under the action of the respective sliding engagements without the possibility of the sliders tilting; whereby said translation bar, when it attains a position in which it registers with said groove of the stator, moves towards the outside by displacing the sliders, thus disengaging these latter from the tumblers and allowing, in such position, the substitution of the key with the consequent different codification of the lock.

2. A lock according to claim 1, wherein said tumblers have, on the side turned towards said stop bar, an operating recess and a series of simulation recesses.

3. A lock according to claim 1, wherein said projections of the sliders and of the stop bar are substantially conical or shaped like a chisel point or a rake, and said recesses which cooperate with said projections are substantially conical or dihedral or rake-like in shape.

4. A lock according to claim 1, wherein said members for sliding engagement are shaped substantially like a dovetail or with a circularly expanded end border.

5. A lock according to claim 1, wherein said stop bar and said translation bar each have associated springs which bias them toward the outside.

6. A lock according to claim 1, wherein said tumblers have a length less than the corresponding chord of the cylinder, and further comprising counter-tumblers inserted in said seatings of the stator, each counter-tumbler having an associated spring.

7. A lock according to claim 1, further comprising a ball mounted in said stator, having an associated spring and engaging said cylinder in the position of change of key in a position registering with the inner end of the key when this latter is completely inserted into the key receiving slit.

8. A lock according to claim 1, further comprising a ball mounted in said stator and engaging said cylinder in the position of change of key in order to prevent extraction of a key provided with a registering recess.

* * * * *